United States Patent [19]

Paterson et al.

[11] 4,107,034

[45] Aug. 15, 1978

[54] AIR SCREW CLASSIFIER

[75] Inventors: Malcolm M. Paterson, Lee, N.H.; Michael R. Grubbs, Houston, Tex.; Peter J. Cambourelis, Lexington, Mass.; Vernon L. Schrimper, Cedar Rapids, Iowa

[73] Assignee: Raytheon Company, Lexington, Mass.

[21] Appl. No.: 728,686

[22] Filed: Oct. 1, 1976

[51] Int. Cl.[2] ..... B07B 1/20; B07B 1/22; B07B 9/02

[52] U.S. Cl. ..... 209/135; 209/152; 209/473

[58] Field of Search ..... 209/152, 482, 289, 290, 209/298, 294, 10, 11, 451, 452, 473, 453, 300, 306, 296, 297, 288, 172.5, 136, 137; 432/118, 106; 34/126, 135; 110/14

[56] References Cited

U.S. PATENT DOCUMENTS

| | | | |
|---|---|---|---|
| 2,069,164 | 1/1937 | Vogel-Jorgensen | 432/118 |
| 2,212,062 | 7/1940 | Duerr et al. | 432/106 |
| 2,238,161 | 4/1941 | Drew et al. | 110/14 |
| 2,701,060 | 2/1955 | Smith | 209/290 |
| 3,556,498 | 1/1971 | Sheahan | 432/118 |
| 3,942,455 | 3/1976 | Wallis | 110/14 |

*Primary Examiner*—Frank W. Lutter
*Assistant Examiner*—Jon Hokanson
*Attorney, Agent, or Firm*—H. A. Murphy; J. D. Pannone; J. T. Meaney

[57] ABSTRACT

An air classifier system for separating mixed materials and comprising the combination of a horizontal drum or tunnel having a feed screw therein at one end of which mixed materials are deposited for movement toward the discharge end of the drum, and means for directing a flow of air through the drum at relatively high velocity for entraining and removing light materials from the drum while permitting heavy materials to be independently moved out of the drum by the screw.

5 Claims, 8 Drawing Figures

FIG. 7
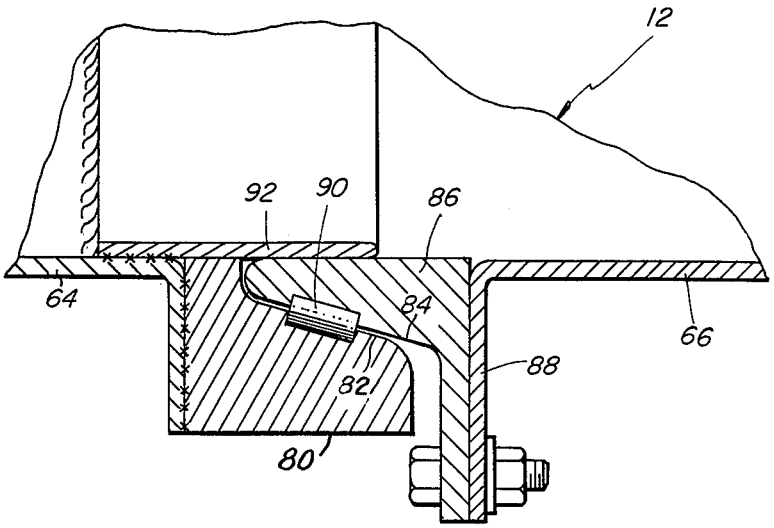
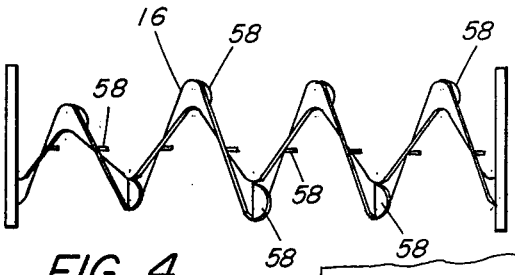
FIG. 4
FIG. 3
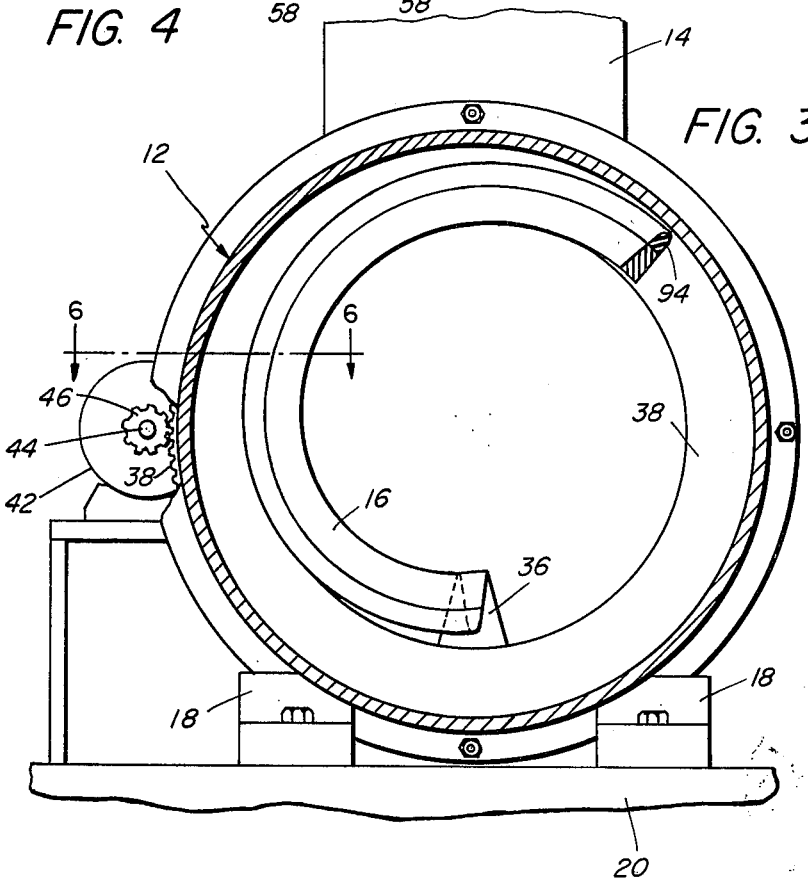

AIR SCREW CLASSIFIER

BACKGROUND OF THE INVENTION

Air classification of materials such as found in municipal waste, for example, is often performed in an inclined rotating drum wherein heavy materials deposited in the rotating drum are moved gradually and progressively downwardly and out the lower end of the drum while light materials become entrained in an air stream passing through the drum and are carried out the upper end of the drum. Such classifier apparatus is also used for many other applications such as in minerals and grain processing.

In such known apparatus, the light materials are carried by the air stream into a plenum chamber where they are in turn separated into light and heavy fractions, the heavy fractions dropping to the bottom of the chamber while the light fractions continue to be entrained within the air stream which passes upwardly and out the top of the plenum chamber into a cyclone collector.

The rotary drum which accomplishes the first separation is fed with mixed materials from a hopper or other supply source by a suitable conveyor, which may be a vibrator, belt or screen conveyor, which has its discharge end located adjacent to the inlet end of the drum. The air stream is created by a blower system located on the cyclone collector.

As an example of the prior art, reference may be made to abandoned U.S. application Ser. No. 580,373, assigned to the same assignee as the present invention.

SUMMARY OF THE INVENTION

The present invention relates to material separation apparatus which embodies a horizontally disposed cylinder, drum, or tank which may be inclined downwardly if desired, containing an axially disposed rotatable screw. Material to be separated is fed into the inlet or upper end of the cylinder and is moved by the screw toward and out the lower or discharge end of the cylinder.

During its passage through the cylinder, the material is subjected to a relatively high velocity stream of air which is propelled through the drum and entrains within it light materials from the mixture, carrying the entrained light materials out the discharge end of the drum into a plenum chamber. The air stream flows through the plenum chamber and into a cyclone collector where it deposits the entrained light materials. The remaining materials which are too heavy to be entrained in the air stream are urged along the bottom of the drum by the screw and eventually fall out the discharge end of the drum into the bottom of the plenum chamber. These separated heavy materials subsequently will be removed as by a suitable conveyor to a remote location for further processing or disposal.

In one embodiment of the invention the drum is stationary and separation is accomplished by the screw in conjunction with the air stream. In a second embodiment at least a portion of the drum is rotatable to aid in separation by creating turbulence in the material as it proceeds through the drum. In either embodiment, the screw may be provided with lifters to create further turbulence in or tumbling of the materials during their passage through the drum. Relatively fast removal of heavy materials may be facilitated by inclining the drum downwardly.

BRIEF DESCRIPTION OF THE DRAWINGS

Other objectives and advantages of the invention will become apparent from the following description taken in connection with the accompanying drawings, wherein

FIG. 3 is an enlarged vertical sectional view taken substantially on line 3—3 of FIG. 1 looking in the direction of the arrows;

FIG. 4 is a diagrammatic side elevational illustration of a feed screw of a type particularly suitable for use in this invention;

FIG. 7 is an enlarged fragmentary sectional view taken substantially on line 7—7 of FIG. 2 looking in the direction of the arrows.

DESCRIPTION OF THE PREFERRED EMBODIMENTS

Figure 1:
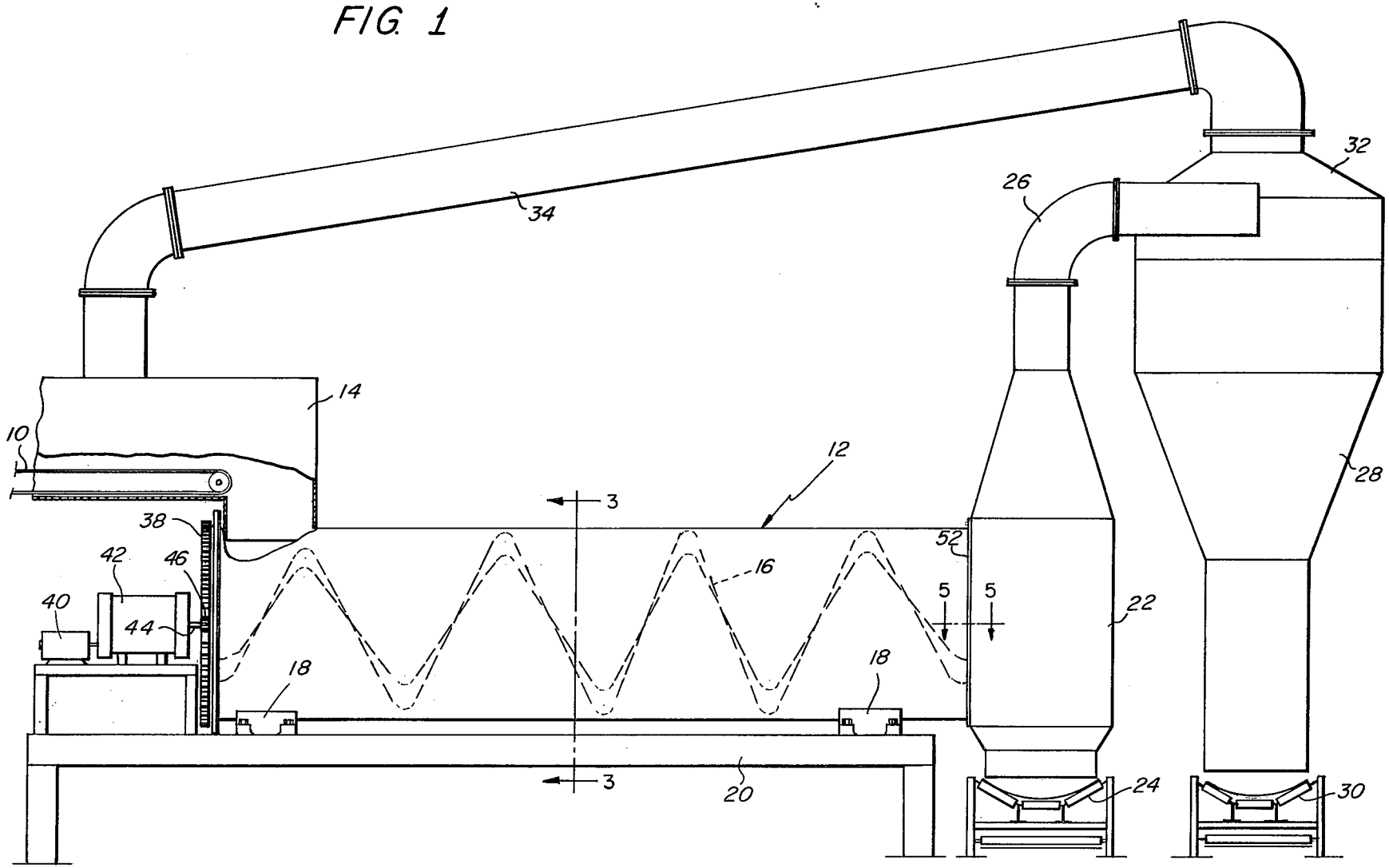
FIG. 1 is an elevational view of an air drum classifier system embodying the invention.

Referring more particularly to the drawings wherein like characters of reference designate like parts throughout the several views, the system shown in FIG. 1 includes a conveyor 10 by means of which mixed materials to be classified or separated are fed into a drum tunnel or cylinder 12. The conveyor 10 is enclosed by a housing 14 which communicates at one end with the inlet end of the drum by a suitable opening whereby the materials can be deposited within the interior of the drum.

The drum 12 in the FIG. 1 embodiment is a hollow horizontally disposed cylinder containing a feed screw 16 which extends longitudinally and coaxially therein. Feed screw 16 may be any suitable conventional screw which will urge mixed materials toward the discharge end of the drum 12, such as the screw 16 shown in FIG. 4. The screw 16 may be of uniform diameter throughout its length but preferably will have a small diameter portion at the inlet end which progressively merges into a large diameter portion toward the opposite end, which larger portion has a diameter which approaches the inner diameter of the drum 12 so that mixed materials will be efficiently moved toward the discharge end of the drum 12. The screw 16 is preferably a hollow structure comprising an arrangement of spiral ribbon flights or turns as shown so that a flow of air at relatively high velocity may pass axially through the device, as wil be described hereinafter.

The drum 12 in FIG. 1 is fixedly supported in horizontal position upon cradles 18 which are mounted upon a suitable base 20. The discharge end of the drum 12 is positioned within an opening in a side wall of a plenum chamber 22 so that materials from the drum may be discharged into the plenum chamber 22 during operation of the system.

The lower end of the plenum chamber 22 is disposed above a suitable conveyor 24 and is provided with suitable discharge means (not shown) so that controlled loading of the conveyor 24 may be accomplished.

The upper end of the plenum chamber 22 communicates by duct 26 with an upper end portion of a cyclone collector 28 which has its lower end positioned above a conveyor 30 as shown. At the upper end of the cyclone collector 28 is a suitable blower 32 which is connected by duct 34 with conveyor housing 14. Thus, the blower 32 operates to force a controlled relatively high velocity stream of air from the cylcone collector 28 through duct 34 and housing 14 into the inlet end of drum 12. This air stream is then drawn out of the discharge end of the drum 12 into plenum chamber 22 and upwardly through duct 26 into the cyclone collector 28 for air classification of the mixed materials as will be more fully described hereinafter.

Figure 6:
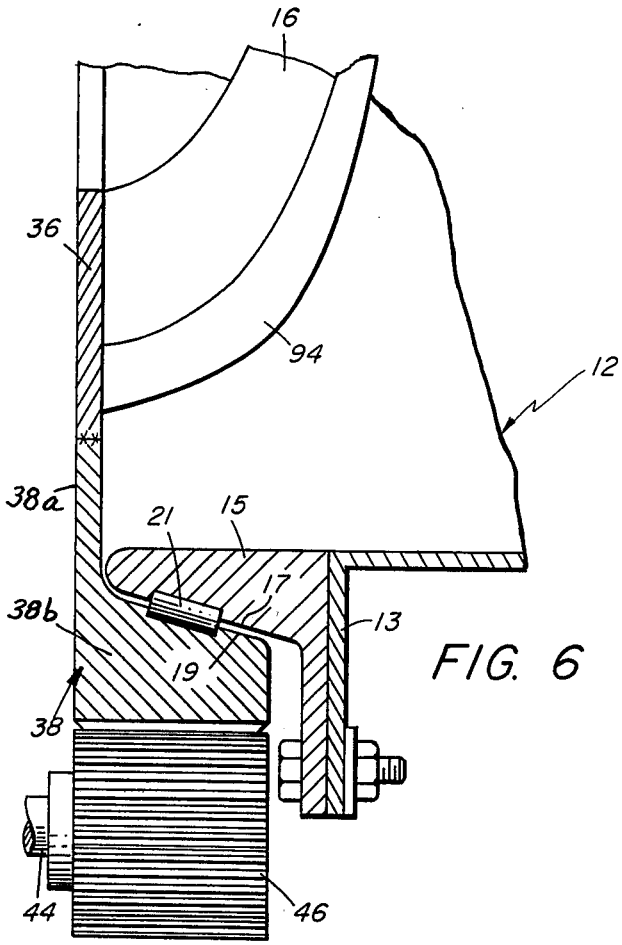
FIG. 6 is an enlarged fragmentary sectional view taken substantially on line 6—6 of FIG. 3 looking in the direction of the arrows.

The feed screw 16, at the inlet end of the drum 12, is welded or otherwise fixedly secured at its end to a boss or bracket 36 carried on the inner periphery of a ring gear 38 which has an annular portion mounted over the end of the drum 12. The adjacent end of the drum 12 is provided with an outwardly directed peripheral flange 13 to which is bolted or otherwise secured a bearing ring 15 (FIG. 6) which has an angled outer bearing surface 17 which overlies an inner angled bearing surface 19 on a flanged portion **38*b* of the ring gear 38 which overlies the outer periphery of the inlet end of the drum. Between angled surfaces 17 and 19 are located suitable bearings 21 which provide means for efficient rotation of the ring gear 38** upon the end of the drum.

A motor 40 (FIG. 1) is suitably mounted on the base 20 and is connected to a suitable gear reduction device 42 from which extends a shaft 44 carrying a drive gear 46 which meshes with the ring gear 38. Thus, upon operation of the motor 40, resultant rotation of drive gear 46 will cause resultant rotation of the ring gear 38 and consequent rotation of the feed screw 16 about its longitudinal axis.

Figure 5:
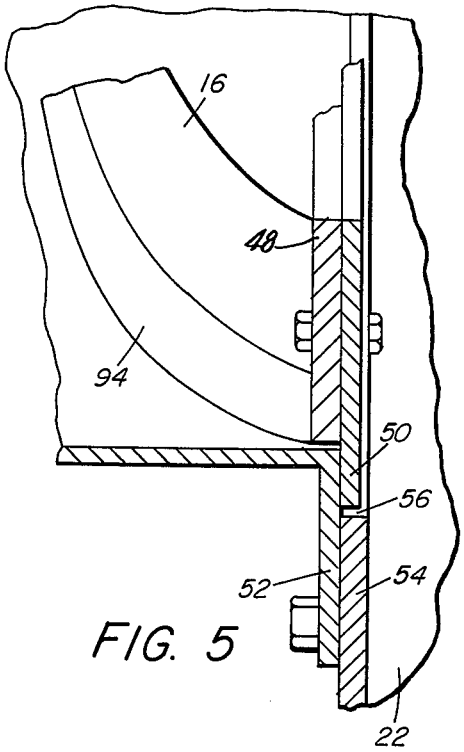
FIG. 5 is an enlarged fragmentary sectional view taken substantially on line 5—5 of FIG. 1 looking in the direction of the arrows.

The opposite end of the screw 16 is welded or otherwise rigidly fixed to the inner side of a ring 48 (FIG. 5) which is rotatably positioned within the discharge end of the drum 12 and bolted to a retaining ring or collar 50 positioned adjacent to the end of the drum as shown best in FIG. 5. Drum 12 may be provided with a circumferential flange 52 which is bolted to the adjacent wall 54 of the plenum chamber 22 so that retainer ring 50 will rotatably reside within the inlet opening 56 in wall 54.

Thus, it will be understood that in operation of the device the motor 40 will be energized to cause the feed screw to rotate. Simultaneously therewith, the blower device 32 will be operated to create the air stream through the drum 12. Then when mixed materials are dropped into the drum 12 from conveyor 10, they will be moved toward the discharge end of the drum by the feed screw 16.

During this movement of the mixed materials, the air stream will entrain light materials such as paper, for example, and will carry such light materials out of the drum 12, and through the plenum chamber 22 and duct 26 into the cyclone collector 28. Within the cyclone collector the light materials will be separated from the air stream by the normal operation of a device of this character, the light materials dropping to the bottom of the collector while the air stream is drawn out of the collector by the blower 32 and subsequently circulated back into the drum via duct 34 and housing 14.

The heavy materials within the drum 12 will not be entrained within the air stream and will thus be moved along the bottom of the drum and will eventually drop into the bottom of the plenum chamber 22.

It will be apparent that the utilization of a hollow screw 16 facilitates the flow of the air stream through the drum and increases tumbling of the materials as they progress through the drum, thereby increasing the overall efficiency of classification. To further increase tumbling within the supply of mixed materials within the drum, the forward surfaces of the turns of the screw may be suitably provided with agitators or lifters 58 as shown in FIG. 4 whereby the materials are constantly and repetitively subjected to rising and falling through the air stream as they move along the drum.

In the operation of an efficient classification system of this type, it may be sometimes desirable to more quickly remove the heavy materials from the drum 12 so the bottom of the drum is angled downwardly toward the plenum chamber. Thus, gravitational forces assist in the removal of the heavy materials from the drum. Such adjustment of the angle of inclination of the drum can also be performed to adjust the ratio of light-to-heavy materials being separated in the drum. To perform the adjustment of the angle of inclination of the drum, any suitable means may be employed such as the jack posts 60 shown in FIG. 8. However, it is to be understood that any desired manual or automatic mechanical, electrical, hydraulic, pneumatic, or other means may be utilized for the purpose.

Figure 8:
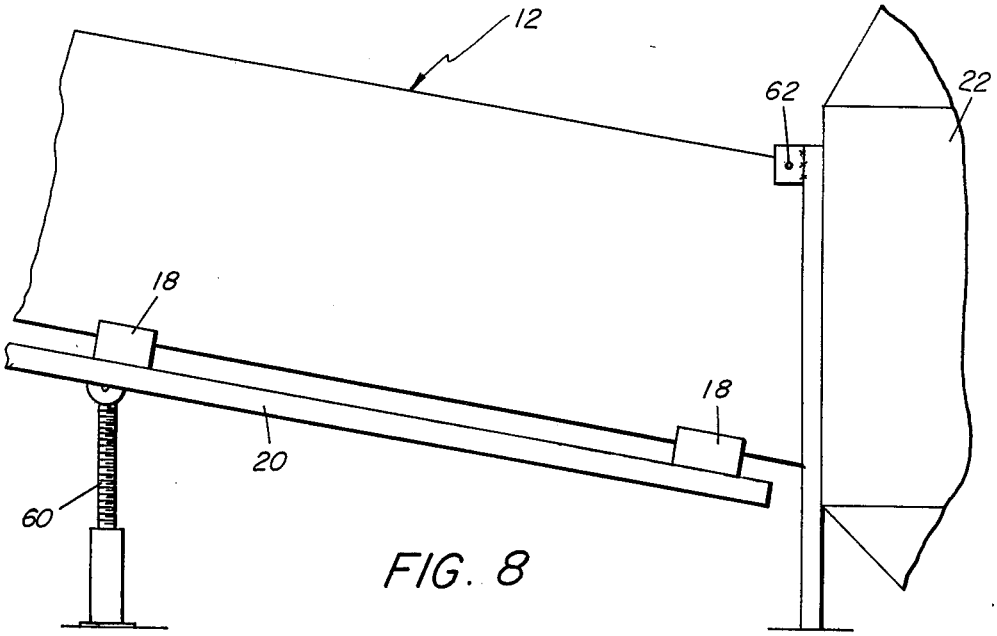
FIG. 8 is a diagrammatic illustration depicting the angular adjustment of the drum.

In the event that the drum 12 is to be inclined as shown in FIG. 8, it is best that the inclining be done about an axis located near the upper extremity of the drum near the plenum chamber 22, such as about the pivot point 62. In this way, no serious disruption occurs at the juncture of the drum with the plenum chamber.

Figure 2:
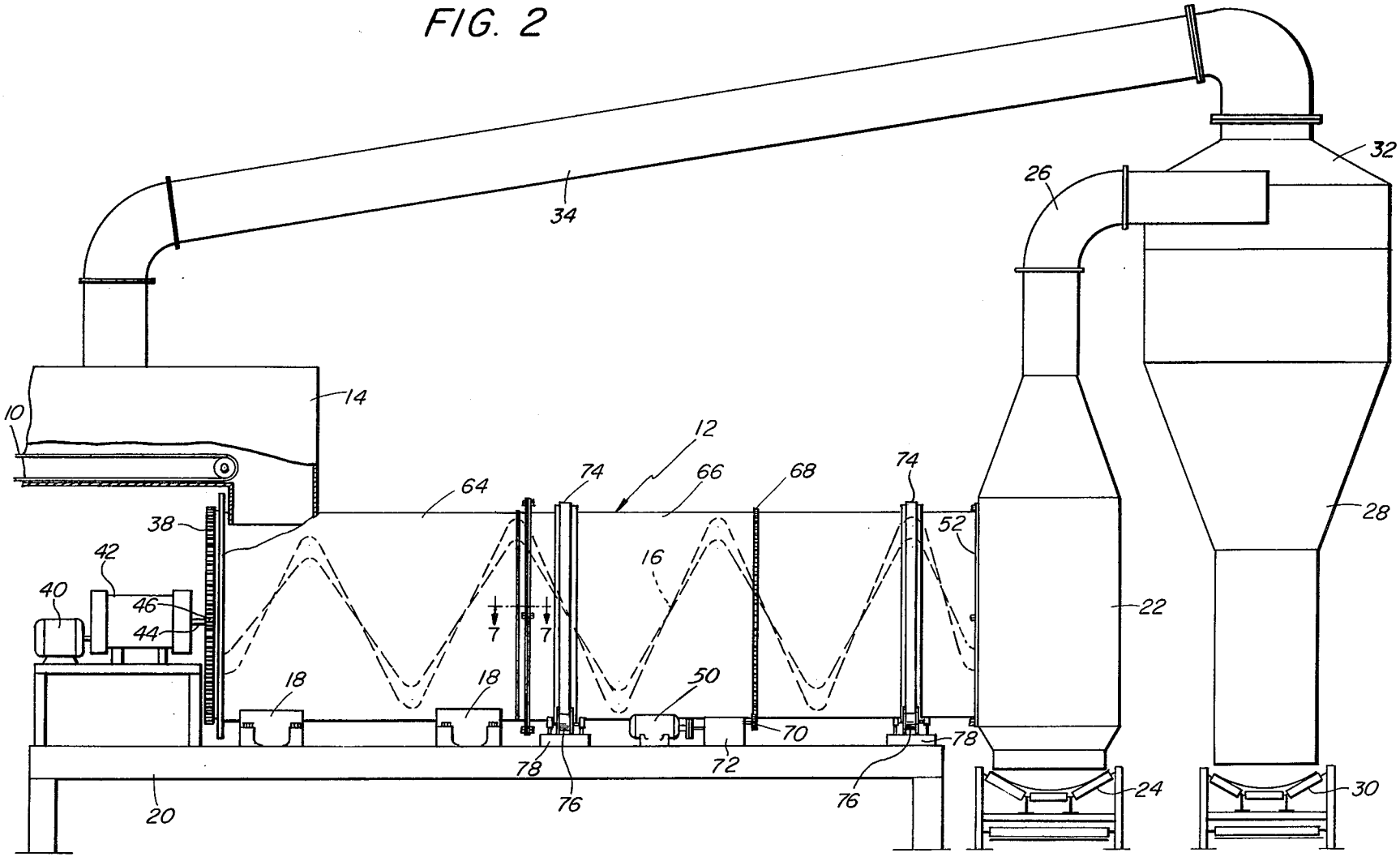
FIG. 2 is an elevational view similar to FIG. 1 showing a drum classifier having a rotatable drum position.

Referring now to the embodiment shown in FIG. 2, means may be provided for creating still greater turbulence of the mixed materials within the drum 12 during the process of classification. In this embodiment the drum 12 comprises two sections 64 and 66 located in end-to-end alignment. Section 64 is stationary and supported by the afore-described cradles 18 on base 20. Section 64 comprises the inlet portion of the drum. Section 66, which comprises the discharge portion of the drum, is provided at a selected point midway of its length with a fixed circumferential sprocket wheel 68 which is driven by suitable means including a small sprocket wheel 70 rotatably mounted on one end of a shaft extending from a reduction gear box 72 which is interconnected with a drive motor 50 on base 20 whereby rotation of the drum section 66 is accomplished.

To prevent longitudinal displacement of the drum section 66, there are provided two fixed restraining rings or collars 74 extending around the circumference of the drum section 66 and spaced from respective ends thereof. Each ring 74 engages a respective roller 76 mounted by suitable bearings in a support 78 carried by the base 20. Flanges on the sides of the rollers 76 prevent longitudinal movement of the drum section 66 as it is rotated.

In the FIG. 2 embodiment, the stationary drum section 64 has at its forward end a peripheral end bearing portion 80 of enlarged diameter (FIG. 7) provided with an angled inner bearing surface 82 upon which rests an angled outer bearing surface 84 of a ring 86 which is bolted or otherwise fixed to a peripheral outwardly directed flange 88 formed on the adjacent end of the rotary drum section 66. Suitable bearings 90 are disposed between the adjacent angled surfaces 82 and 84 so as to reduce friction between the drum sections 64 and 66 when section 66 is rotated.

A suitable circumferentially extending plate 92 carried by the end of stationary drum section 64 overlies the space between the angled surfaces 82 and 84 to prevent materials from entering the space as they are moved from the stationary section 64 into the rotary section 66.

It will be apparent that when the rotary drum section 66 is made to revolve, this will provide a substantial amount of turbulence within the materials being processed, resulting in more efficient separation of light materials from heavy materials by the air stream passing through the drum.

As described above, heavy materials from the drum in either embodiment of the invention will drop into the bottom of the plenum chamber 22, while light materials entrained in the air stream will pass through the plenum chamber 22 and duct 26 into the cyclone collector 28 where they will be separated from the air stream and deposited in the collector in the normal manner of operation of a device of this character. Thus, the heavy materials from the plenum chamber 22 can eventually be removed from the area by conveyor 24 for further processing or disposal, and the light materials can eventually be removed from the area by conveyor 30 for further processing such as, for example, by being converted to fuel.

The screw 16 may be made of a suitable hard, wear-resistant metal and its outer edge surface preferably carries a resilient blade 94 for yieldable engagement with the materials being processed.

From the foregoing it will be apparent that all of the objectives and advantages of the invention have been achieved in the classifier shown and described. It will also be apparent, however, that various modifications and changes in the structures shown and described and in their methods of operation may be made by those skilled in the art without departing from the spirit of the invention as expressed in the accompanying claims. Therefore, all matter shown and described is to be interpreted as illustrative and not in a limiting sense.

What is claimed is:

1. An air drum classifier for separating mixed solid materials into heavy and light materials, comprising an elongated drum having an inlet end and a discharge end spaced therefrom, a rotary feed screw extending axially within the drum, said screw being comprised of an arrangement of spiral ribbon flights providing an unobstructed opening extending throughout its axis, means for rotating said screw, the drum having an opening adjacent its inlet end whereby a mixture of solid materials may be deposited within the screw so as to be moved toward the discharge end by the screw, means for directing a stream of air longitudinally through the drum and axially through the screw for entraining light materials from said mixture and carrying them out of the drum through said discharge end while heavy materials move progressively along the drum and out said discharge end separately from the light materials, said feed screw being supported at one end by a ring gear which is rotatably mounted on the inlet end of the drum and rotatable with respect thereto, said one end of the feed screw being operatively connected to said gear.

2. A classifier as set forth in claim 1 wherein a bearing ring is fixedly mounted on the inlet end of the drum, and said ring gear includes an annular portion mounted over the inlet end of the drum and a flanged portion which overlies the outer periphery of said bearing ring and is rotatable thereon.

3. An air drum classifier for separating mixed solid materials into heavy and light materials, comprising an elongated drum having an inlet end and a discharge end spaced therefrom, a rotary feed screw extending axially within the drum, said screw being comprised of an arrangement of spiral ribbon flights providing an unobstructed opening extending throughout its axis, means for rotating said screw, the drum having an opening adjacent its inlet end whereby a mixture of solid materials may be deposited within the screw so as to be moved toward the discharge end by the screw, means for directing a stream of air longitudinally through the drum and axially through the screw for entraining light materials from said mixture and carrying them out of the drum through said discharge end while heavy materials move progressively along the drum and out said discharge end separately from the light materials, said feed screw being supported at one end by a first ring rotatably mounted within the discharge end of the drum and connected with a retainer ring which is mounted over and slidable on the discharge end of the drum, said one end of the feed screw being fixed to said ring.

4. A classifier as set forth in claim 3 wherein the discharge end of the feed screw is fixed to said first ring which is mounted within the discharge end of the drum and is fixed to said retainer ring for rotatably supporting the discharge end of the feed screw within the drum.

5. A classifier as set forth in claim 4 wherein the rigid member is an annulus.

* * * * *